US005810992A

United States Patent [19]

Troup-Packman

[11] Patent Number: 5,810,992

[45] Date of Patent: Sep. 22, 1998

[54] ELECTROPLATING OF IRON-COBALT ALLOY ONTO ALUMINUM ALLOY PARTS

[75] Inventor: Sue Troup-Packman, Newbury Park, Calif.

[73] Assignee: Hughes Electronics Corporation, El Segundo, Calif.

[21] Appl. No.: 807,927

[22] Filed: Feb. 28, 1997

[51] Int. Cl.[6] ..... C23C 28/02; C25D 3/56

[52] U.S. Cl. ..... 205/187; 205/255; 205/259

[58] Field of Search ..... 205/187, 255, 205/259

[56] References Cited

U.S. PATENT DOCUMENTS

| | | | |
|---|---|---|---|
| 3,098,803 | 7/1963 | Godycki et al. | 205/187 |
| 4,226,681 | 10/1980 | Shirahata et al. | 204/38 ST |

OTHER PUBLICATIONS

G.O. mallory and J.B. Hajdu, *Electroless Plating,* American Electroplaters and Surface Finishers Society, Orlando, Fl. pp. 196–201 (1990). no month available.

*Primary Examiner*—Kathryn L. Gorgos
*Assistant Examiner*—Edna Wong
*Attorney, Agent, or Firm*—V. D. Duraiswamy; W. K. Denson-Low

[57] ABSTRACT

A process for plating aluminum alloy substrates such as aluminum pistons with an iron-cobalt alloy comprising the steps of (a) plating on the aluminum alloy substrate a thin layer of nickel from an electroless nickel bath; and (b) plating on the nickel layer a layer of iron-cobalt alloy from an iron-cobalt electroplating bath. The iron-cobalt layer is not subject to the corrosion problems inherent in a substantially pure iron-plated coating nor the excessive hardness, costliness, and environmental concerns related to the use of nickel as the primary plated layer. The iron-cobalt electroplating bath is cost-effective and can be utilized in a totally closed loop plating system. The resulting iron-cobalt plated, aluminum alloy parts evidence good adhesion, wear, thermal conductivity, and corrosion-resistant properties.

2 Claims, 1 Drawing Sheet

ELECTROPLATING OF IRON-COBALT ALLOY ONTO ALUMINUM ALLOY PARTS

TECHNICAL FIELD

The present invention relates to the plating of metal parts, and, more particularly, to the plating of aluminum alloy parts with iron-cobalt alloys.

BACKGROUND ART

In the use of aluminum internal combustion engines with aluminum pistons, it is essential that either the piston or the bore be coated or lined with another metal to prevent piston skirt scuffing during cold starts and "galling" and seizing when the oil has drained from the piston between periods of engine operation. Several approaches have been used in the past: the pistons or cylinder walls have been coated with iron or nickel and the cylinder walls have been lined with steel sleeves.

The most widely-used solution, lining the bore with steel sleeves, solves the problem of galling, seizing and scuffing but introduces other problems. The major drawbacks of using a steel sleeve are the greatly increased cost of manufacturing the engine block and a substantial increase in weight, in comparison to plating the piston. However, pistons plated with iron still exhibit corrosion and galling problems, while nickel plating of the piston proves to be too hard and easily chipped as well as costly and potentially harmful to the environment.

What is needed is a method of plating aluminum parts which provides a coating that is hard but not brittle, wear and corrosion resistant, low cost, and thermally conducting, and that may be deposited on the aluminum parts in an environmentally-friendly manner.

DISCLOSURE OF INVENTION

In accordance with the invention, an iron-cobalt alloy layer is plated onto aluminum alloy parts as a substitute for both the iron and nickel plating techniques previously employed as well as for the use of steel sleeves. The iron-cobalt layer is not subject to the corrosion problems inherent in a substantially pure iron-plated coating nor the excessive hardness, costliness, and environmental concerns related to the use of a substantially pure nickel-plated primary layer. The method of plating iron-cobalt alloy onto aluminum alloy substrates comprises the steps of:

(a) plating onto the aluminum substrate a thin layer of nickel from an electroless nickel bath; and (b) plating onto the nickel layer a layer of iron-cobalt alloy from an iron and cobalt electroplating bath.

The iron-cobalt bath is cost-effective and can be utilized in a totally closed loop plating system.

The resulting iron-cobalt plated, aluminum alloy parts comprise a first layer of nickel on a surface of the part and a second layer of iron-cobalt alloy on the first layer of nickel. The coating evidences good adhesion, wear, thermal conductivity, and corrosion-resistant properties. Further, the coating is environmentally much safer and less brittle than an outer nickel layer.

BRIEF DESCRIPTION OF THE DRAWINGS

The sole Figure is a schematic drawing of the structure of an aluminum piston coated in accordance with the invention.

BEST MODES FOR CARRYING OUT THE INVENTION

Figure 1:
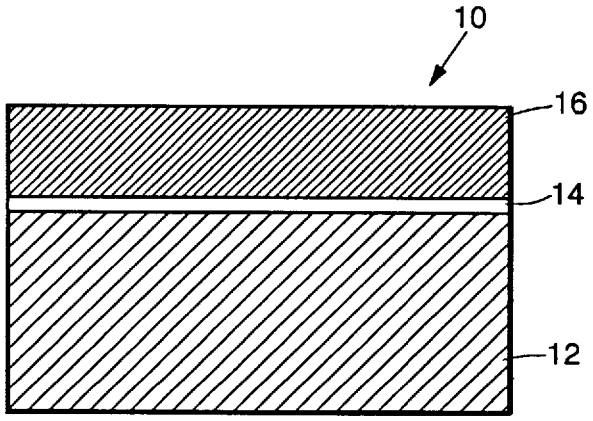

In the process of the invention, the aluminum alloy parts are first meticulously cleaned and degreased to remove grease and oils, typically employing a non-etching, hot alkaline cleaner. An example of a suitably-employed, commercially-available cleaner is ISOPREP 33 made by Allied Kelite, which typically comprises about 30% water, about 30% sulfuric acid, about 30% nitric acid and about 10% ammonium bifluoride. Examples of other suitably-employed cleaners include commercially-available dish-washing compositions such as CHEMIZID 740, an aqueous solution of sodium hydroxide and sodium lauryl sulfate available from Allied-Kelite, and AL-KANOX, an acid-based cleaner having a proprietary composition available from VWR Scientific. The immersion time in such cleaners typically ranges from about 15 seconds to 1 minute. If the part is very oily or greasy, a solvent degrease step may be inserted prior to the alkaline cleaning step.

The cleaned parts are then rinsed in cold running water, acid-etched for 10 seconds to remove aluminum oxides, and rinsed again with cold water. A well-known acid etch suitably employed in the practice of the invention for removing aluminum oxides comprises about 50% water, about 25% sulfuric acid, about 24% nitric acid, and about 1% hydrofluoric acid. However, any of the acid etches known for removing aluminum oxides may be employed, such as a solution of ammonium bifluoride double salt, commercially available as ARP 28 from Allied Kelite.

The parts are now ready for plating. In the first plating step, the parts are immersed in a well known "striking" bath such as a water solution of nickel chloride, (240 g/L) and hydrochloric acid (60 g/L), similar to that described by Mallory et al. (G. O. Mallory and J. B. Hajdu, *Electroless Plating*, American Electroplaters and Surface Finishers Society, Orlando, Fla., pp. 196–201 (1990)). It is noted that the present concentrations refer to nickel chloride and hydrochloric acid exclusive of the water used for hydration. Commercially-available nickel chloride is represented by the formula $NiCI_2 \cdot xH_2O$, with x being 0, 6, or indeterminate, but typically close to 1. Additionally, a commercially-available example of a suitably employed electroless nickel bath includes, but is not limited to, a proprietary electroless nickel solution comprising an aqueous solution of nickel sulfate, sodium hypophosphate, and additional proprietary salts available from Allied Kelite under the tradename ELECTROLESS NICKEL 794. Any of the known electroless nickel solutions may be employed in the practice of the invention. The bath is made up according to the manufacturer's directions and is typically heated to 185° to 200° F. (85° to 93.3° C.), and preferably about 190° F. (87.8° C.). Immersion time is typically about 1 minute.

The thickness of the nickel coating preferably ranges from about 0.00002 to 0.00004 inch (0.00005 to 0.0001 cm) to provide a layer to which the subsequently-plated iron-cobalt layer will adhere. A nickel thickness less than about 0.00002 inch may be provide insufficient adherence of the iron-cobalt layer thereto, and a nickel thickness greater than about 0.00004 inch may be too brittle.

The nickel-coated parts are rinsed with cold running water and then immersed in an iron-cobalt plating bath. The iron-cobalt plating bath comprises (a) about 300 to 400 g/L ferrous methanesulfonate (also known as iron(II) methanesulfonate); (b) about 40 to 50 g/L cobalt(II) methanesulfonate; and (c) about 1 to 3 g/L of ascorbic acid. The concentration of ascorbic acid employed strongly affects the hardness of the resulting coating. If the concentration of ascorbic acid is too high, the coating will be too hard and brittle. On the other hand, if the ascorbic acid concentration is too low, the iron could be readily air-oxidized to the ferric state, such that the coating would be very susceptible to rusting. The balance of the solution is water, preferably distilled water. The bath is preferably maintained within the range of about 70° to 85° C. during the immersion of the aluminum alloy part. A bath temperature higher than 85° C. is expected to produce an undesirably soft coating, while a bath temperature lower than 70° C. would likely result in an undesirably brittle coating. Preferably, the pH of the bath is maintained within the range of about 0.8 to 2.0.

The iron-cobalt plating bath may also include appropriate addition agents, such as surfactants, wetters, and the like, to enhance the plating characteristics. Preferably, the bath includes about 0.1 vol % of a wetter, such as ROHCO 11 wetter. The composition and concentration of such addition agents are well-known in the art and hence do not form a part of this invention.

The iron anode is cold-rolled or electrolytic iron. The iron anode must have at least twice the surface area of the part to be plated (such as a piston) and must be able to maintain the ferrous iron level of the plating bath at a minimum of about 50 g/L. To accommodate cobalt depletion of the plating bath, about 20 g. of cobalt metal is added to the bath after every 1500 ampere-minutes. Alternatively, cobalt(II) methanesulfonate could be added to the bath as needed to maintain the necessary cobalt concentration, or anodes made of the desired iron/cobalt alloy may be employed.

The cleaned, nickel-plated aluminum part and the iron anode are immersed in the plating bath, and a plating voltage within the range of about 3 to 6 volts is impressed on the part, as cathode. Preferably, the plating current is about 20 to 30 milliamps per square centimeter of aluminum alloy surface, which provides the best combination of fast plating time consistent with good visual appearance of the iron-cobalt plate. It is noted that for a typical single aluminum alloy piston to be plated, the plating bath preferably has a minimum volume of about 15 liters.

During the plating process, the bath is stirred without the introduction of air bubbles, such as by rotating the piston. Under these conditions the plating of the iron-cobalt alloy should proceed at a rate of approximately 1 to 2 $\mu$m per minute.

The iron-cobalt alloy is preferably plated to a thickness within the range of about 0.0005 to 0.002 inch (0.0013 to 0.005 cm), and most preferably to about 0.001 inch (0.002 cm). A thickness of less than 0.0005 inch does not provide for adequate wear. A typical dwell time of about 7 minutes at 30 milliamps per square centimeter is used to obtain a thickness of about 0.001 inch, although shorter or longer times with correspondingly higher or lower current densities may be employed in the practice of the invention to generate the desired thickness. The iron-cobalt plated part is rinsed in cold running water. The resulting iron-cobalt layer is contemplated to comprise about 3 to 10 wt % cobalt and balance substantially iron. Although not mandatory for the practice of the invention, the iron-cobalt plated part may be plated with an outer tin layer.This may be accomplished by immersing the plated part in a tin plating bath, such as a proprietary alkaline tin bath available from M&T Harshaw under the tradename AT 221-B, to form a tin "strike". The bath is typically operated at 20 amps/ft$^2$ (215.3 amps/m$^2$).If a tin layer is employed, it is plated on to a thickness of about 0.000005 to 0.0001 inch (0.000012 to 0.00025 cm) following the manufacturer's instructions. Preferably, a "strike", ranging in thickness from about 0.000007 to 0.000015 inch (0.0000178 to 0.000038 cm) is employed. A typical dwell time for the "strike" thickness is about 30 seconds. The tin-plated part is rinsed in cold runing water.

The sole Figure is a schematic diagram of an iron-cobalt-coated aluminum alloy piston 10, comprising a 390 aluminum piston casting 12 onto which an electroless-plating nickel layer 14, e.g., about 0.00003 inch in thickness, is formed. An iron-cobalt layer 16, e.g., about 0.001 inch in thickness, is plated onto the nickel layer 14. It is noted that the teachings of the present invention, while specifically directed to plating 390 aluminum alloy pistons, which is a silicon-aluminum alloy containing about 18% silicon, are equally applicable to the iron plating of other aluminum alloys and of other aluminum alloy parts.

Often, a bake step is employed following electroplating of, for example, iron onto an aluminum alloy. Such as baking step is intended to remove hydrogen embrittlement and to improve adhesion of the plated coating. The bake step is typically carried out at an elevated temperature, such as about 350° to 400° F., typically about 375° F., for a period of time, such as about 1 to 3 hours, typically about 1 hour. While other aluminum alloys, such as 6061, may require baking following plating, 390 aluminum alloy does not appear to require such treatment.

It is very important for many applications, such as plating of aluminum alloy pistons, that the plating have an acceptable hardness. For pistons, this hardness should be equivalent to a Rockwell hardness within the range of about 40 to 50 on the C scale. A hardness of less than about 40 would be insufficient for the anticipated environment in which the pistons will be employed, and a hardness of more than about 50 may be too brittle and have poor adhesion. The practice of this invention provides iron-cobalt coatings of acceptable hardness for such applications.

The present electroplating method for applying iron-cobalt alloys to aluminum substrates as disclosed herein and aluminum parts so treated are expected to find commercial use in manufacturing any lightweight aluminum engine.

Thus, there has been disclosed a method for electroplating iron-cobalt alloys onto aluminum parts. An aluminum alloy part electroplated using the disclosed method has been disclosed as well. It will be readily apparent to those skilled in the art that various changes and modifications of an obvious nature may be made without departing from the spirit of the invention, and all such changes and modifications are considered to fall within the scope of the invention as defined by the appended claims.

What is claimed is:

1. A method of increasing hardness and minimizing brittleness of an iron-cobalt alloy plating on an aluminum alloy substrate comprising the steps of:

(a) plating on said aluminum alloy substrate a layer of nickel from an electroless nickel bath, said nickel layer having a thickness within a range of about 0.00002 to 0.00004 inch (0.00005 to 0.0001 cm); and (b) electroplating on said nickel layer a layer of iron-cobalt alloy from an iron-cobalt electroplating bath, said iron-cobalt alloy layer having a thickness within the range of about 0.0005 to 0.002 inch (0.0013 to 0.005 cm), said iron-cobalt alloy electroplating bath comprising an aqueous solution of about 300 to 400 grams/L of ferrous methanesulfonate, about 40 to 50 grams/L of cobalt(II) methanesulfonate, and about 1 to 3 grams/L ascorbic acid.

2. A method of plating iron-cobalt alloy onto an aluminum alloy substrate, comprising the steps of:

(a) plating on said aluminum alloy substrate a layer of nickel from an electroless nickel bath, said nickel layer having a thickness within a range of about 0.00002 to 0.00004 inch (0.00005 to 0.0001 cm); and (b) electroplating on said nickel layer a layer of iron-cobalt alloy from an iron-cobalt electroplating bath, said iron-cobalt alloy layer having a thickness within a range of about 0.0005 to 0.002 inch (0.0013 to 0.005 cm), said iron-cobalt alloy having a Rockwell hardness within a range of about 40 to 50 on a C scale.

* * * * *